US007073225B1

(12) United States Patent
Ford

(10) Patent No.: US 7,073,225 B1
(45) Date of Patent: Jul. 11, 2006

(54) PLAQUE ERADICATING SYSTEM UTILIZING A PLURALITY OF DOUBLE-SIDED TOOTHBRUSHES OR TOOTHBRUSH HEADS

(76) Inventor: Stephen C Ford, 28870 Monterey Dr., Southfield, MI (US) 48076

( * ) Notice: Subject to any disclaimer, the term of this patent is extended or adjusted under 35 U.S.C. 154(b) by 0 days.

(21) Appl. No.: 10/463,014

(22) Filed: Jun. 17, 2003

(51) Int. Cl.
*A46B 9/04* (2006.01)

(52) U.S. Cl. ..... 15/167.2; 15/176.1; 15/110; 15/111; 132/310

(58) Field of Classification Search ..... 15/160, 15/167.1, 167.2, 176.1, 176.2, 110, 111; D4/104, D4/105, 108, 113; 132/308, 309, 310
See application file for complete search history.

(56) References Cited

U.S. PATENT DOCUMENTS

| | | | | | |
|---|---|---|---|---|---|
| 1,125,532 | A * | 1/1915 | Himmel | 15/117 |
| 1,618,027 | A * | 2/1927 | Vogler | 211/60.1 |
| 2,253,210 | A * | 8/1941 | Psiharis | 601/139 |
| D130,437 | S * | 11/1941 | Patterson | D4/106 |
| 3,742,549 | A * | 7/1973 | Scopp et al. | 15/167.1 |
| 4,519,111 | A * | 5/1985 | Cavazza | 15/167.1 |
| 4,633,542 | A * | 1/1987 | Taravel | 15/167.1 |
| 4,731,896 | A * | 3/1988 | de La Tour | 15/106 |
| 5,920,941 | A * | 7/1999 | Iannotta | 15/106 |
| 6,076,223 | A * | 6/2000 | Dair et al. | 15/167.1 |
| 6,119,296 | A * | 9/2000 | Noe et al. | 15/104.94 |
| 6,345,406 | B1 * | 2/2002 | Dodd | 15/176.1 |
| D459,087 | S * | 6/2002 | Pfleger | D4/104 |
| 6,671,919 | B1 * | 1/2004 | Davis | 15/167.1 |
| 2004/0134007 | A1 * | 7/2004 | Davies | 15/110 |

* cited by examiner

*Primary Examiner*—Richard Crispino
*Assistant Examiner*—Shay Balsis
(74) *Attorney, Agent, or Firm*—Michael I. Kroll

(57) ABSTRACT

The present invention 10 discloses a plaque eradicating toothbrush series having a set of toothbrushes 12, 22, 28 with multiple functions and can be provided with interchangeable brush heads or in one piece. Both sides of the toothbrush comprise either brushes 12 or one side brush and the opposing side an inner mouth cleaner or tongue scraper 22, 28. The present invention 10 is comprised of plastic, rubber and synthetic bristles. The device 10 provides effective and efficient brushing, excellent oral hygiene resulting in fewer cavities, healthier gums and fresher breath. Some of the benefits of the present invention 10 are no wasted brush strokes, convenient angled design at 18 of handle 20, simultaneously cleans upper and lower teeth, removes plaque and bacteria and germs from the tongue and mouth walls and helps freshen breath.

1 Claim, 10 Drawing Sheets

PLAQUE ERADICATING SYSTEM UTILIZING A PLURALITY OF DOUBLE-SIDED TOOTHBRUSHES OR TOOTHBRUSH HEADS

BACKGROUND OF THE INVENTION

1. Field of the Invention

The present invention relates generally to toothbrushes and, more specifically, to a system utilizing a plurality of double-sided toothbrushes or toothbrush heads on an interchangeable handle to provide a means for more effectively and efficiently removing plaque from teeth and preventing the initial build-up of plaque.

The build-up of plaque is one of the foremost causes of gum disease. Plaque build often results in diseases such as gingivitis and bone loss which often require painful and costly oral surgery to correct. Furthermore, bad breath often results from plaque and bacteria that thrive in the warm, moist host of the mouth and can be a hindrance and embarrassment in social situations.

Many devices are known in the art seek to address the problem of controlling and preventing plaque build-up but the present invention utilizes a plurality of multiple function toothbrushes or interchangeable toothbrush heads to provide a comprehensive oral hygiene program to address all of the elements responsible for developing plaque build-up and other associated disorders of the mouth.

2. Description of the Prior Art

There are numerous oral hygiene devices known in the art. While these oral hygiene devices may be suitable for the purposes for which they were designed, they would not be as suitable for the purposes of the present invention as hereinafter described.

SUMMARY OF THE PRESENT INVENTION

The present invention discloses a plaque eradicating toothbrush series having a set of toothbrushes with multiple functions and can be provided with interchangeable brush heads or in one piece. Both sides of the toothbrush comprise either brushes or one side brush and the opposing side an inner mouth cleaner or tongue scraper. The present invention is comprised of plastic, rubber and synthetic bristles. The device provides effective and efficient brushing, excellent oral hygiene resulting in fewer cavities, healthier gums and fresher breath. Some of the benefits of the present invention are no wasted brush strokes, convenient angled design, simultaneously cleans upper and lower teeth, removes plaque and bacteria and germs from the tongue and mouth walls and helps freshen breath.

A primary object of the present invention is to provide a comprehensive program of oral hygiene for removing plaque, bacteria and other such harmful elements from the teeth, gums and tongue.

Another object of the present invention is to provide a program of oral hygiene that utilizes a plurality of double-sided toothbrushes to satisfy multiple functions.

Still another object of the present invention is to provide a program of oral hygiene that utilizes a plurality of interchangeable double-sided toothbrush heads that snap onto a universal handle to satisfy multiple functions.

Another object of the present invention is to provide a program of oral hygiene providing a head with bristles on one side and a retractable tongue scraper on the other side Still another object of the present invention is to provide a program of oral hygiene that is simple and easy to use.

Still yet another object of the present invention is to provide a program of oral hygiene that is inexpensive to manufacture and use.

Additional objects of the present invention will appear as the description proceeds.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawings in which.

LIST OF REFERENCE NUMERALS

Figure 1:
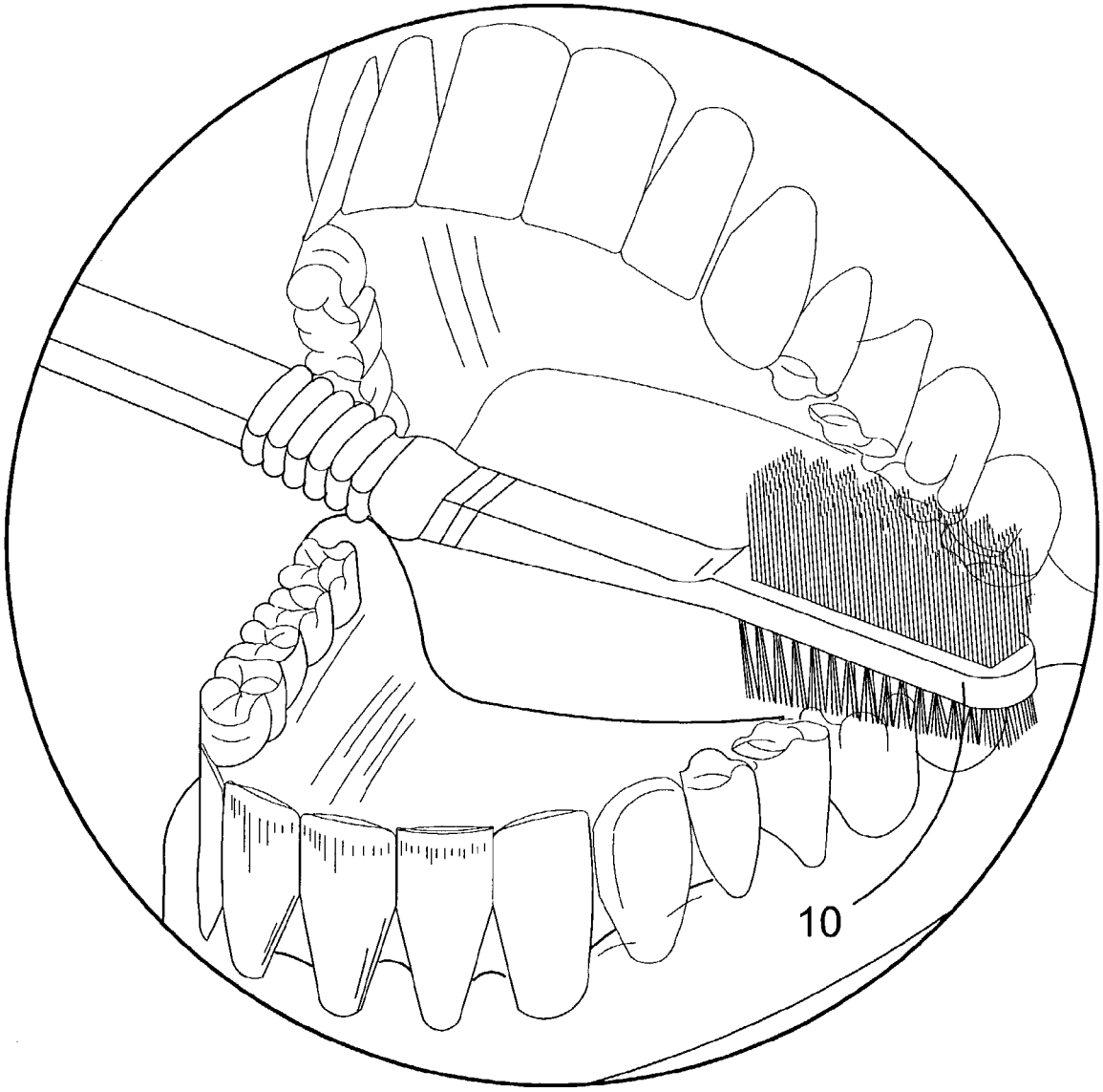
FIG. 1 is an illustrative view of the present invention in use.

With regard to reference numerals used, the following numbering is used throughout the drawings

10 present invention
12 first toothbrush
14 first bristles
16 second bristles
18 angled handle
20 handle
22 second toothbrush
24 bristles
26 soft rubber material/inner mouth cleaner
28 third toothbrush
30 bristles
32 soft plastic material/tongue scraper
34 retractable tongue scraper
36 connector

DETAILED DESCRIPTION OF THE PREFERRED EMBODIMENT

The following discussion describes in detail one embodiment of the invention. This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 in use. The present invention 10 is a plaque eradicating toothbrush series having a set of toothbrushes with multiple functions and can be provided with interchangeable brush heads or in one piece. Both sides of the toothbrush comprise either perpendicularly disposed bristles or one side bristles and the opposing side an inner mouth cleaner or tongue scraper. The present invention 10 is comprised of plastic, rubber and synthetic bristles. The device 10 provides effective and efficient brushing, excellent oral hygiene resulting in fewer cavities, healthier gums and fresher breath. Some of the benefits of the present invention 10 are no wasted brush strokes, convenient angled design, simultaneously cleans upper and lower teeth, removal of plaque and bacteria and germs from the tongue and mouth walls and it helps freshen breath.

Figure 2:
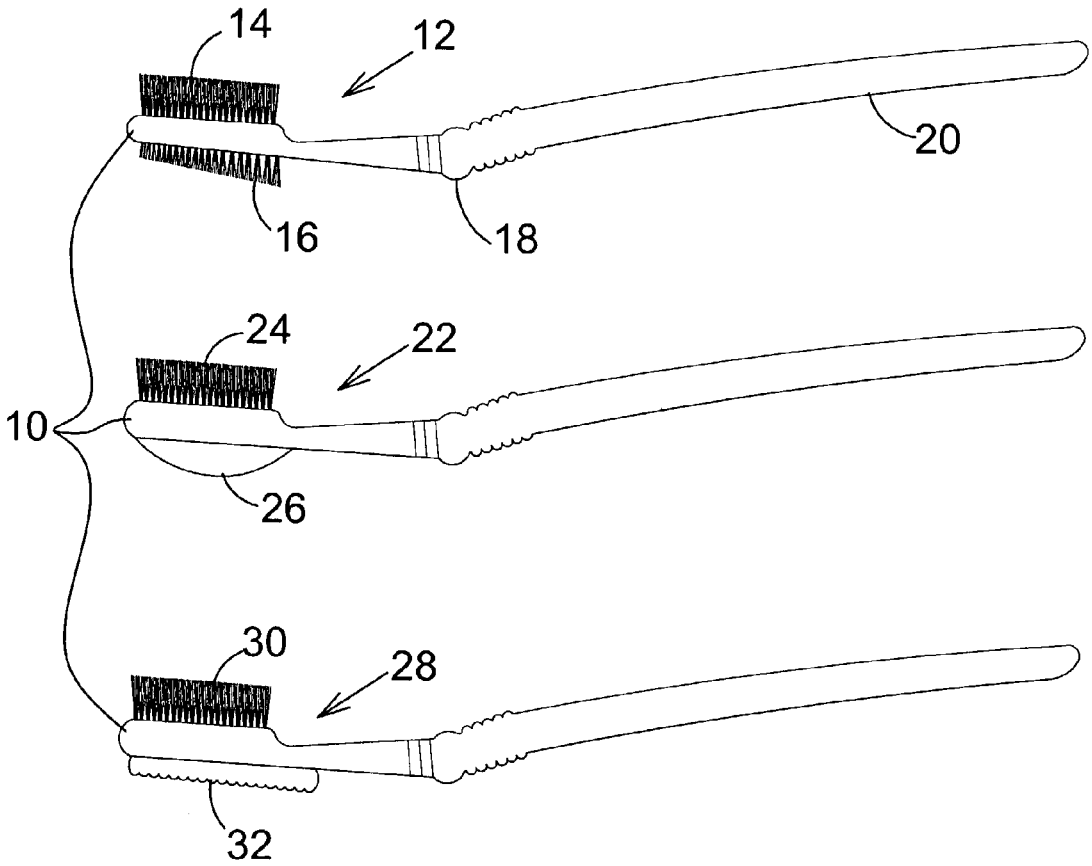
FIG. 2 is side view of the plaque eradication toothbrush series of the present invention.

Turning to FIG. 2, shown therein is a side view of the plaque eradication toothbrush series of the present invention 10. The present invention 10 is a plaque eradicating toothbrush series having a plurality of toothbrushes with multiple functions. The first toothbrush 12 comprises brushes 14, 16 on both sides, designed to clean both top and bottom teeth in the same stroke. The angled design at 18 of the handle 20 would allow it to fit easily into the mouth using handle 20. The second toothbrush 22 will contain a soft rubberized material 26 on one side that will allow the user to clean the inside of the mouth and bristles 24 on the other side. The third toothbrush 28 will comprise bristles 30 on one side and a soft plastic type material 32 used to clean the tongue on the opposing side.

As also seen in FIG. 2, all of the toothbrushes have raised platforms on the side from which the bristles extend and the opposite sides are aligned with the respective handles. The raised platforms cover the full widths of the sides from which the bristles extend, as illustrated in FIG. 4.

Figure 3:
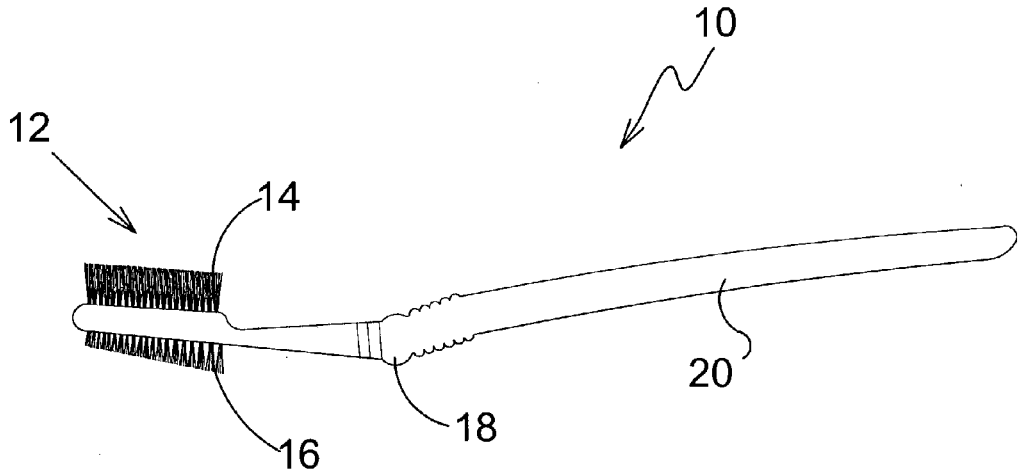
FIG. 3 is a side view of the double bristled toothbrush of the present invention.

Turning to FIG. 3, shown therein is a side view of the double bristled toothbrush 12 of the present invention 10. Shown is the first toothbrush 12 of the present invention having bristles 14, 16 disposed on opposing sides designed to clean both top and bottom teeth in the same stroke. Bristles 16 vary in length having shorter bristles disposed toward the first, front end of the toothbrush head wherein the tips of the bristles form a straight line to permit the teeth of a user to be cleaned. The handle 20 having an angled design at 18 would allow it to fit easily into the mouth.

Figure 4:
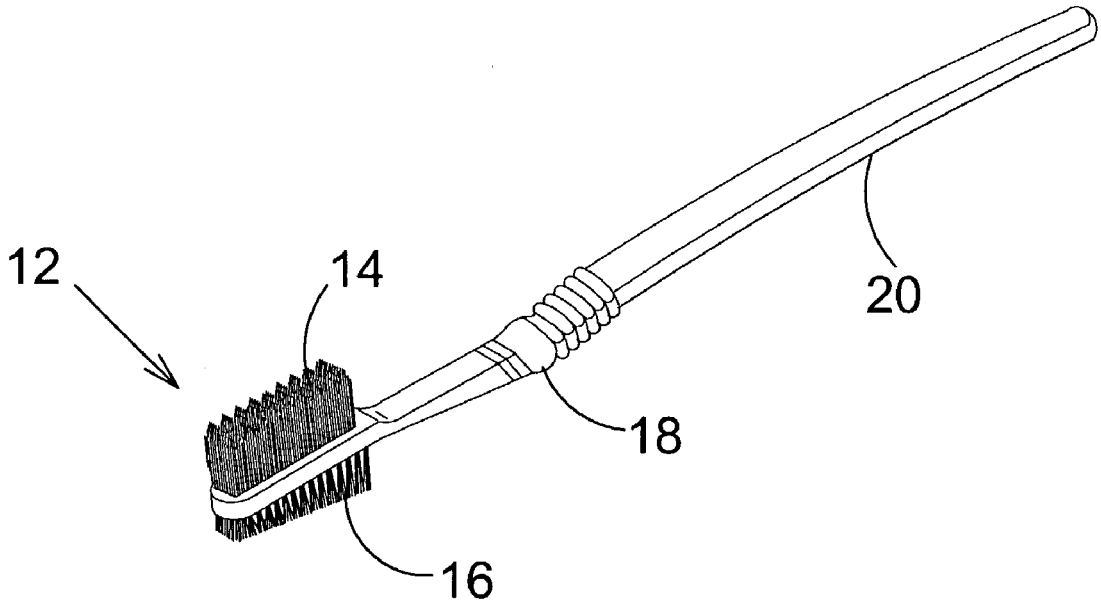
FIG. 4 is a perspective view of the double-bristled toothbrush of the present invention.

Turning to FIG. 4, shown therein is a perspective view of the double bristled toothbrush 12 of the present invention. Shown is a perspective view of the first toothbrush 12 of the present invention comprising brushes 14, 16 on both sides that are designed to clean both top and bottom teeth in the same stroke. The handle 20 having an angled design at 18 would allow it to fit easily into the mouth.

Figure 5:
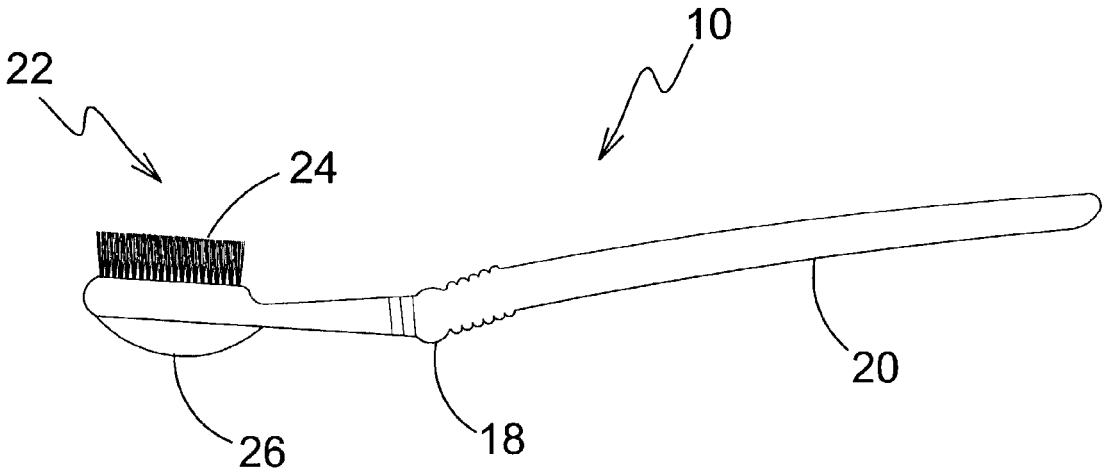
FIG. 5 is a side view of the toothbrush with rubberized tool of the present invention.

Turning to FIG. 5, shown therein is a side view of the toothbrush 22 with rubberized tool 26 of the present invention 10. Shown is the second toothbrush 22 of the present invention comprising a soft rubberized material 26 on one side and bristles 24 on the other that will allow the user to clean the inside of the mouth and brush the teeth. The handle 20 having an angled design at 18 would allow it to fit easily in the mouth. The rubberized tool 26 may be configured in any suitable size to accomplish the task at hand, however the preferred dimensions have a minimum length of 1¼" and a maximum length of 1½" with the width at center not to be less than ¼" and not to exceed 5/16".

Figure 6:
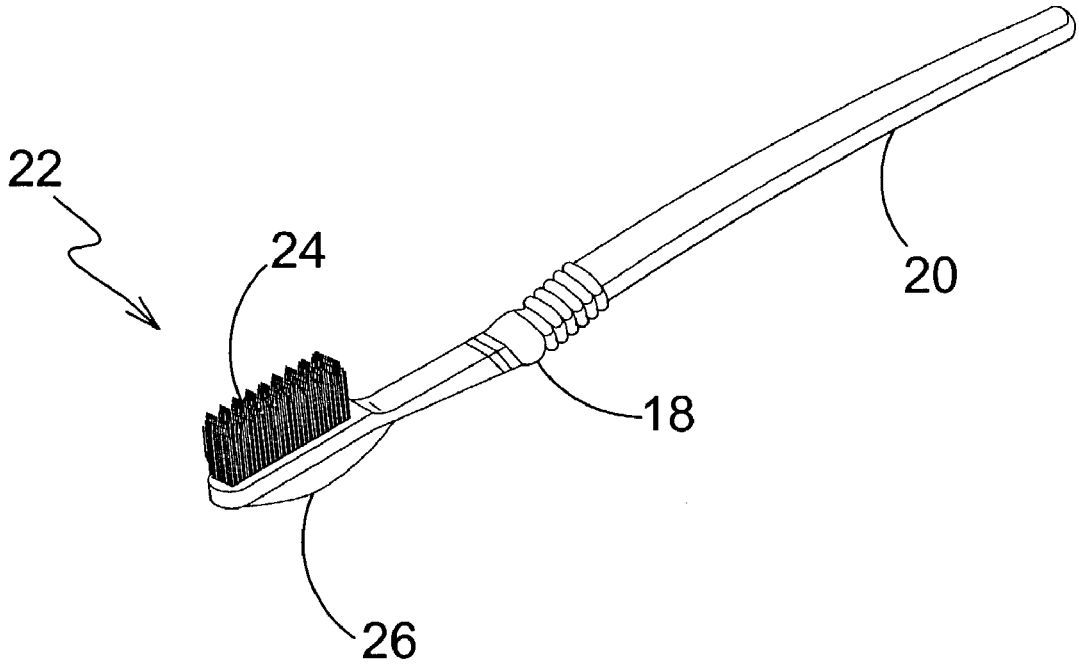
FIG. 6 is a perspective view of the toothbrush with rubberized tool of the present invention.

Turning to FIG. 6, shown therein is a perspective view of the toothbrush 22 with rubberized tool 26 of the present invention. Shown is a perspective view of the second toothbrush 22 of the present invention comprising a soft rubberized material 26 on one side and bristles 24 on the other that will allow the user to clean the inside of the mouth and brush the teeth. The handle 20 having an angled design at 18 would allow it to fit easily in the mouth.

Figure 7:
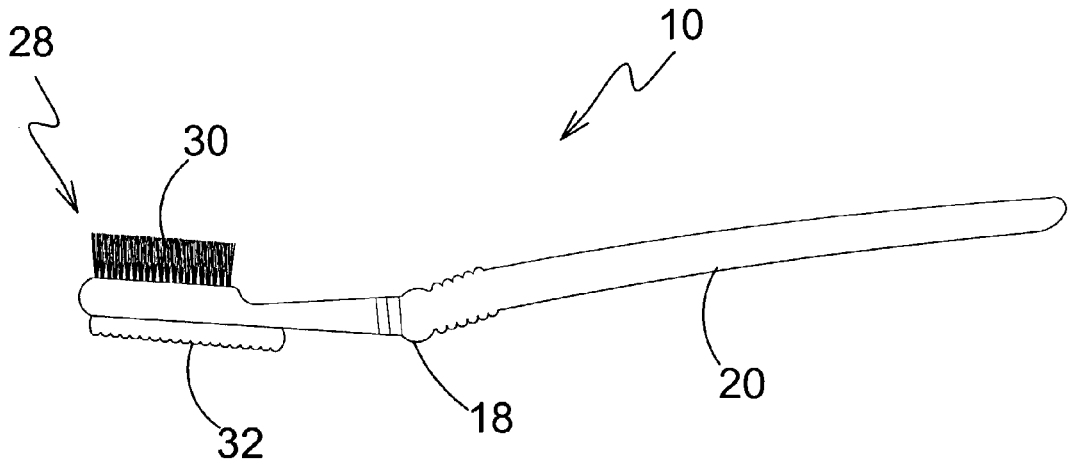
FIG. 7 is a side view of the toothbrush with a tongue scraper of the present invention.

Turning to FIG. 7, shown therein is a side view of the toothbrush 28 with a tongue scraper 32 of the present invention 10. Shown is a side view of the third toothbrush 28 of the present invention comprising a soft plastic material 32 on one side used to clean the tongue and bristles 30 on the other that will allow the user to clean the tongue and brush the teeth. Material 32 has a knurled surface for cleaning the tongue. The handle 20 having an angled design at 18 would allow it to fit easily in the mouth.

Figure 8:
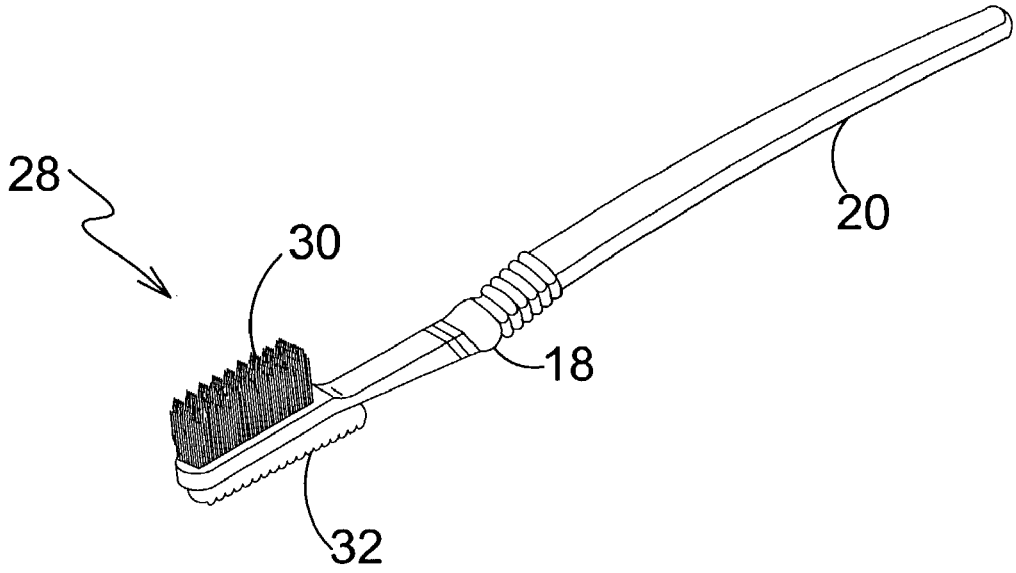
FIG. 8 is a perspective view of the toothbrush with tongue scraper of the present invention.

Turning to FIG. 8, shown therein is a perspective view of the toothbrush 28 of the present invention. Shown is a perspective view of the third toothbrush 28 of the present invention comprising a soft plastic material 32 on one side used to clean the tongue and bristles 30 on the other that will allow the user to clean the tongue and brush the teeth. The handle 20 having an angled design at 18 would allow it to fit easily in the mouth.

Figure 9:
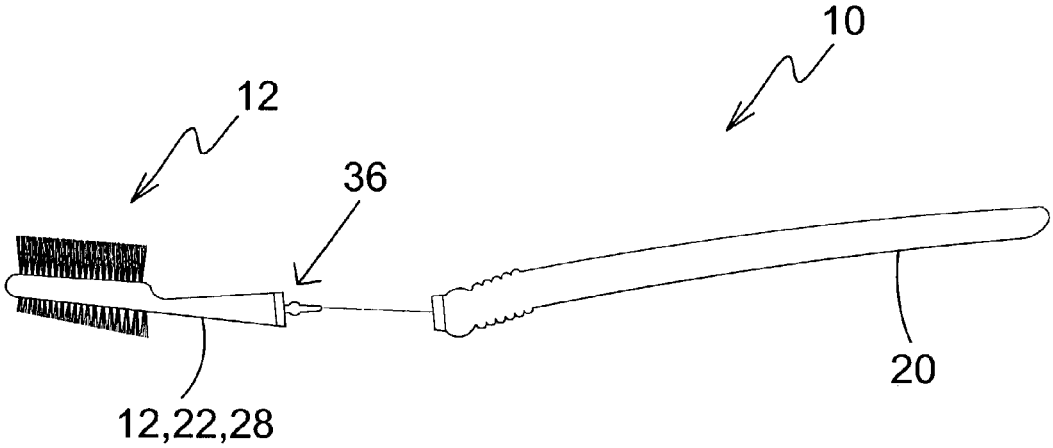
FIG. 9 is a side view of an alternate double bristled toothbrush with interchangeable handle of the present invention.

Turning to FIG. 9, shown therein is a perspective view of the double bristled toothbrush head 12 with interchangeable handle 20 of the present invention 10. The present invention 10 can be provided with interchangeable brush heads 12, 22, 28 (not all shown in FIG. 9) or in one piece. A connector 36 is disposed on the end of the toothbrush heads 12, 22, 28 for connection to the handle 20. Both sides of the toothbrushes 12, 22, 28 comprise bristles on one side and bristles, an inner mouth cleaner or tongue scraper on the other. The present invention 10 is comprised of plastic, rubber and synthetic bristles. The device 10 provides effective and efficient brushing, excellent oral hygiene resulting in fewer cavities, healthier gums and fresher breath. Some of the benefits of the present invention are no wasted brush strokes, convenient angled design, simultaneously cleaning of upper and lower teeth, removal of plaque, bacteria and germs from the tongue and mouth walls and also helps freshen breath.

Figure 10:
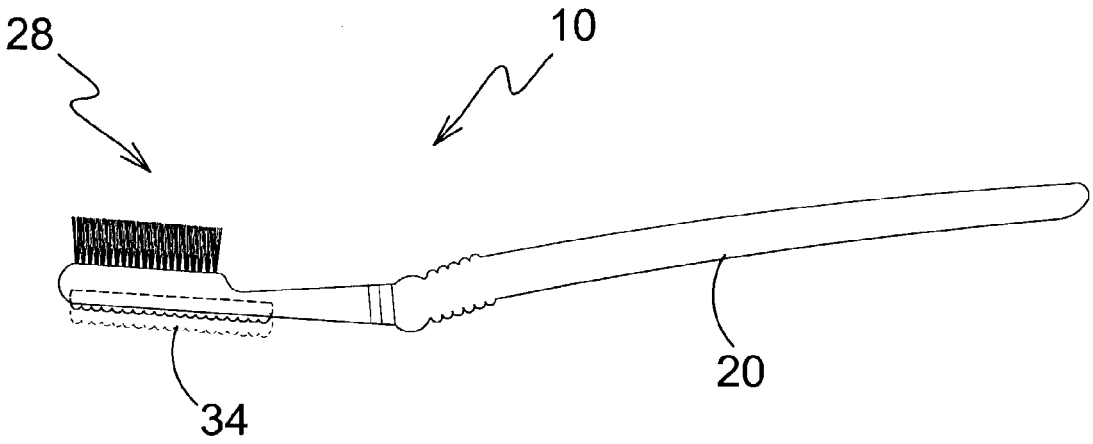
FIG. 10 is a side view of the toothbrush with retractable tongue scraper of the present invention.

Turning to FIG. 10, shown therein is a side view of the toothbrush 28 on handle 20 with retractable tongue scraper 34 of the present invention 10. The tongue scraper 34 of the present invention 10 may include a retractable tongue scraper 34 to allow the user to selectively retract or extend the scraper 34 as needed to prevent the scraper from hindering the brushing process.

As also clearly illustrated in FIG. 10, when tongue scraper 34 is in the retracted position, the knurled surfaced remains exposed above the surface.

I claim:

1. A toothbrush system having a plurality of types of toothbrushes, consisting of:

a) a first toothbrush having first and second opposing ends, a toothbrush head disposed on said first end and a handle disposed on said second end, said toothbrush head having first and second opposing sides wherein a plurality of first bristles are perpendicularly disposed on said first side and a plurality of second bristles are perpendicularly disposed on said second side for brushing the teeth of a user, said second bristles varying in length having shorter bristles disposed toward said first end of said toothbrush head wherein the tips of said bristles form a sloping straight line to permit the teeth of a user to be cleaned;

b) a second toothbrush having first and second opposing ends, a toothbrush head disposed on said first end and a handle disposed on said second end, said toothbrush head having first and second opposing sides wherein a plurality of bristles are perpendicularly disposed on said first side and a soft rubber material is disposed on said second side for cleaning the inner mouth of a user, said soft rubber material being arcuately shaped and perpendicularly disposed to said second side for cleaning the inner mouth of a user;

c) a third toothbrush having first and second opposing ends, a toothbrush head disposed on said first end and a handle disposed on said second end, said toothbrush head having first and second opposing sides wherein a plurality of bristles are perpendicularly disposed on said first side and a soft plastic material with a knurled exposed surface is disposed on said second side for scraping the tongue of a user;

d) the heads of all of said toothbrushes having a raised platform on only the first opposing side from which bristles extend, said raised platform covering a full width of the first opposing side of each head, and the second opposing sides being aligned with the respective handle for each toothbrush;

e) said soft plastic material in said third toothbrush being retractable on said second side of said toothbrush head, the knurled surface of said soft plastic material remaining exposed above the second side when in a retracted position;

f) said handles of said toothbrushes being angled so that each toothbrush is easily inserted into a mouth of a user;

g) said first, second and third toothbrush heads being interchangeable so that said first, second and third toothbrush heads can be interchanged with each other whereby a user can attach the interchangeable heads to a single handle; and h) said means for connecting an interchangeable head to a handle being a male connector member disposed on an end of each said interchangeable head, each handle having a socket to receive said male connector member to receive said connector member.

* * * * *